US009555912B2

(12) United States Patent
Cere' et al.

(10) Patent No.: US 9,555,912 B2
(45) Date of Patent: Jan. 31, 2017

(54) WRAPPING METHOD

(75) Inventors: Mauro Cere', Loiano (IT); Alberto Morri, Rimini (IT)

(73) Assignee: Aetna Group S.p.A. (IT)

( * ) Notice: Subject to any disclaimer, the term of this patent is extended or adjusted under 35 U.S.C. 154(b) by 593 days.

(21) Appl. No.: 14/131,113

(22) PCT Filed: Jul. 6, 2012

(86) PCT No.: PCT/IB2012/053468

§ 371 (c)(1),
(2), (4) Date: Jan. 6, 2014

(87) PCT Pub. No.: WO2013/008161

PCT Pub. Date: Jan. 17, 2013

(65) Prior Publication Data

US 2014/0123605 A1 May 8, 2014

(30) Foreign Application Priority Data

Jul. 8, 2011 (IT) ..... MO2011A0170

(51) Int. Cl.

| | |
|---|---|
| ***B65B 67/08*** | (2006.01) |
| ***B65B 11/02*** | (2006.01) |
| ***B65B 11/04*** | (2006.01) |
| *B65B 11/00* | (2006.01) |

(52) U.S. Cl.

CPC ..... *B65B 67/08* (2013.01); *B65B 11/025* (2013.01); *B65B 11/045* (2013.01); *B65B 2011/002* (2013.01)

(58) Field of Classification Search

CPC ..... B65B 67/08; B65B 11/025; B65B 11/04; B65B 11/045

USPC ..... 53/399

See application file for complete search history.

(56) References Cited

U.S. PATENT DOCUMENTS 4,387,548 A * 6/1983 Lancaster ..... A01F 15/071 53/399
4,387,552 A * 6/1983 Lancaster ..... A01F 15/071 53/211
4,503,658 A * 3/1985 Mouser ..... B29C 55/06 53/399

(Continued)

*Primary Examiner* — Gloria R Weeks
(74) *Attorney, Agent, or Firm* — Laubscher, Spendlove & Laubscher, P.C.

(57) ABSTRACT

A method for wrapping a load with a film by a wrapping machine including an unwinding apparatus provided with a reel of the film includes moving the wrapping apparatus and the load in relation to one another and unwinding from the reel an established effective length of film per revolution of the wrapping apparatus or of the load. The established effective length of film is calculated with the formula: where: $S_f$: initial length of film is determined on the basis of dimension and/or shape of the load; ω: rotation speed around a wrapping axis of the unwinding apparatus or of the load; $V_t$: movement speed of the unwinding apparatus parallel to the rotation axis; $^{\omega}$max: maximum rotation speed around the wrapping axis of the unwinding apparatus or of the load; $\Delta_{corr}$: corrective parameter.

8 Claims, 2 Drawing Sheets

(56) References Cited

U.S. PATENT DOCUMENTS

| | | | | |
|---|---|---|---|---|
| 4,514,955 | A * | 5/1985 | Mouser | B65B 11/045 53/211 |
| 5,123,230 | A | 6/1992 | Upmann | |
| 7,114,308 | B2 * | 10/2006 | Cox | B65B 11/045 53/399 |
| 7,707,801 | B2 | 5/2010 | Lancaster, III | |
| 2003/0089081 | A1 * | 5/2003 | Platon | A01F 15/071 53/399 |
| 2004/0031238 | A1 * | 2/2004 | Cox | B65B 11/045 53/399 |
| 2006/0248858 | A1 * | 11/2006 | Lancaster | B65B 11/025 53/399 |
| 2011/0131927 | A1 | 6/2011 | Lancaster | |
| 2014/0116007 | A1 * | 5/2014 | Lancaster, III | B65B 11/025 53/461 |
| 2014/0123605 | A1 * | 5/2014 | Cere' | B65B 11/025 53/461 |

* cited by examiner

WRAPPING METHOD

This application is a §371 National Stage Entry of PCT/IB2012/053468 filed Jul. 6, 2012. Application No. PCT/IB2012/053468 claims priority to Italian Application No. MO2011A000170 filed Jul. 8, 2011. The entire contents of these applications are incorporated herein by reference.

BACKGROUND OF THE INVENTION

The invention relates to methods for wrapping a load with a film of cold-stretchable plastics material. In particular, the invention refers to a method that is usable on a wrapping machine for controlling and adjusting wrapping of a film around a load.

Known wrapping machines generally include an unwinding apparatus that supports a reel from which the plastics are unwound for wrapping around the load in such a manner as to form a series of strips or bands with a helical or helix pattern, by virtue of the combination of the movement in a vertical direction of the wrapping apparatus and of the relative rotation between the latter and the load. The latter typically includes one or more products grouped and arranged on a bench or shovel or pallet.

In wrapping machines provided with a rotating table for supporting the load, the latter is rotated around a vertical wrapping axis, whereas the unwinding apparatus is moved vertically with reciprocal movement along a fixed column.

In wrapping machines with a horizontal rotating ring or a rotating arm, the load remains static during wrapping, whereas the unwinding apparatus is moved with respect to the latter, both rotating around the vertical wrapping axis and translating along the latter. For this purpose, the unwinding apparatus is fixed to a ring or to an arm that is rotatably supported by a fixed structure of the machine and in such a manner as to rotate around the load.

In wrapping machines with a vertical ring, the load is moved horizontally through the ring, whereas the unwinding apparatus rotates with the ring around a horizontal wrapping axis.

The unwinding apparatus typically includes a pair of prestretching rollers arranged for unwinding the film from the reel and prestretching or elongating the film, and one or more deflecting or idling rollers arranged for deflecting the film towards the load. By appropriately adjusting the difference between rotation speed of the prestretching rollers, it is possible to prestretch by a defined quantity or percentage the film exiting the unwinding apparatus. By adjusting the rotation speed of the prestretching rollers it is also possible to vary the unwinding speed of the film from the reel, i.e. the speed with which the film exits the unwinding apparatus.

The unwinding apparatus generally includes an electric motor that is able to rotate one of the two prestretching rollers that acts as a master roller and drives, by a transmission/reduction unit, the other prestretching roller that acts as slave roller. In this manner, between the fast roller and the slow roller a predefined transmission ratio is set according to the desired prestretch of the film.

Unwinding apparatuses are further known to include two distinct electric motors for driving the two prestretching rollers independently.

In the operation of known wrapping machines, it is difficult to maintain a force or traction or wrapping tension (so-called "pull") of the film around the load that is almost constant, in order to ensure a value of the wrapping or binding tension that is suitable and appropriate to the type of load to be wrapped. The need to control and limit wrapping tension to avoid film breakage is also known.

The wrapping tension varies for each wrapping revolution according to the dimensions, the shape or cross section of the load to be wrapped and the angular position between the load and the unwinding apparatus. The variations of the wrapping tension can also be considerable, especially in the case of loads with a narrow and long section or a wide and short section.

Wrapping methods are known that maintain an almost constant tension by varying the film unwinding speed, i.e. the exit speed of the film from the unwinding unit by retroactive adjustment of the rotation speed of the prestretching rollers.

For this purpose, sensors are provided (encoders, load cells) that are able to measure film tension directly or indirectly and send a corresponding signal to a control unit of the wrapping machine, the control unit being able to intervene on the motor or on the motors of the prestretching rollers to increase or decrease the rotation speed thereof.

Such retroactive control systems are, however, expensive and difficult to adjust and fine tune. Further, in the case of high performance wrapping machines, the high rotation speeds of the unwinding apparatus do not permit effective and prompt retroactive adjustment of the speed of unwinding of the film from the reel as a function of variations in film tensions.

Wrapping methods are known that control the unwinding speed of the film and/or the quantity of film to be unwound per revolution of the wrapping apparatus around the load or vice versa on the basis of the dimensions of the latter.

U.S. Pat. No. 5,123,230 discloses a wrapping method for a wrapping machine with a vertical ring that adjusts and controls the rotation speed of a film unwinding roller, in order to maintain the desired wrapping tension of the film around the load, on the basis of a sequence of values calculated by a control unit of the machine starting from the dimensions of the load.

U.S. Pat. No. 7,707,801 discloses a wrapping method for a horizontal rotating ring wrapping machine in which for each revolution of an apparatus for unwinding the film around the load a set quantity of film is calculated as a function of the perimeter of the load. The unwinding apparatus, which is fixed to the rotating ring, includes film prestretching rollers that are rotated by a belt wound on a fixed ring, the rotation of the rotating ring determining in this manner the rotation of the prestretching rollers with a defined transmission ratio. In this manner, the predefined quantity of unwound film for each revolution is independent of a rotation speed of the unwinding apparatus.

Such wrapping methods nevertheless do not ensure a satisfactory wrapping quality of the film at all rotation speeds of the unwinding unit around the load. In particular, they do not ensure constant film wrapping or binding tension around the load at all rotation speeds. Further, by unwinding a preset quantity of film for each revolution they encounter variations of the wrapping tension between the bands or strips of film wrapped with helical motion in the central portion of the load and those wrapped with circular motion in the end, lower and upper portions of the load. In order to stabilize the load and consolidate wrapping, it is in fact known to wrap the end portions with a plurality of superimposed strips of film.

If the predefined quantity of film is set to ensure correct tension of the film in the end portions, the wrapping tension in the central portion may be high and lead to an excessive narrowing of the height of the film, consequently increasing the consumption of the film. Conversely, if the wrapping tension in the central portion is correct, the wrapping tension in the end portions may be insufficient, leading to loosening of the binding.

SUMMARY OF THE INVENTION

An object of the invention is to improve known methods for wrapping a load with a film of plastics material in wrapping machines. Another object is to devise a wrapping method that enables a wrapping tension of the film around the load to be controlled and kept substantially constant, regardless of the relative rotation speed of a film unwinding apparatus with respect to the load and/or a position of the unwinding apparatus with respect to the load in the wrapping step.

A further object is to devise a wrapping method that ensures high film wrapping quality around the product.

BRIEF DESCRIPTION OF THE DRAWINGS

The invention can be better understood and implemented with reference to the attached drawings that illustrate some embodiments thereof by way of non-limiting embodiment, in which.

DETAILED DESCRIPTION

Figure 1:
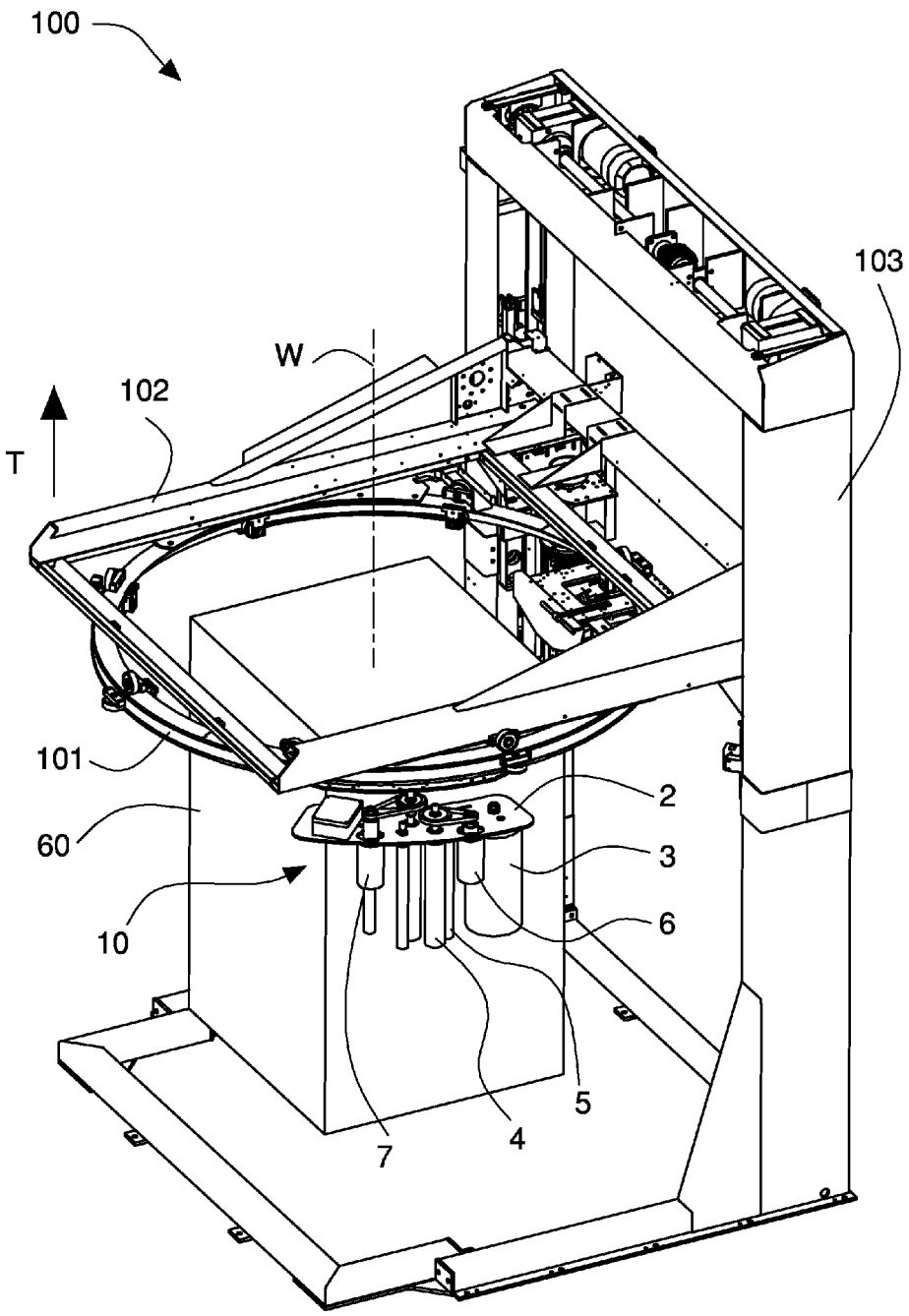
FIG. 1 is a schematic view of a horizontal rotating ring wrapping machine associated with a load to be wrapped.
Figure 2:
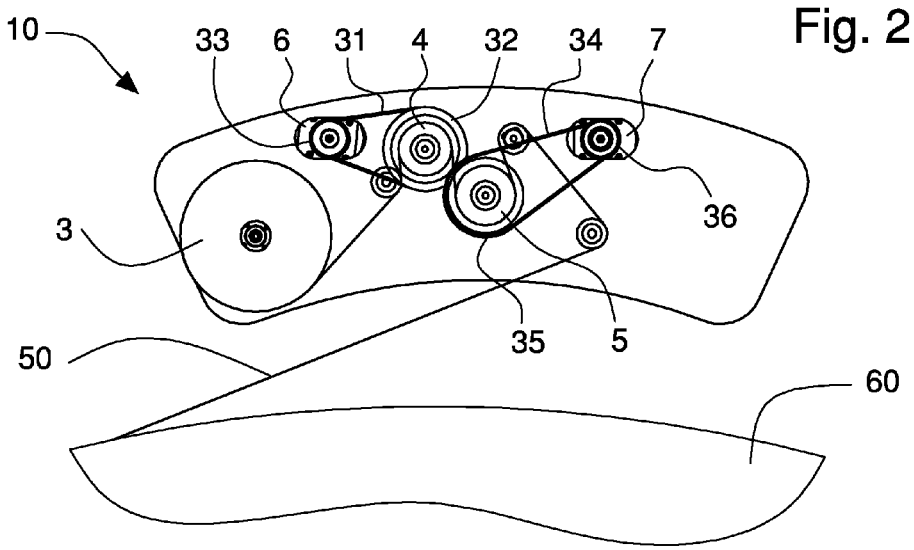
FIG. 2 is a top plan view of a film unwinding apparatus mounted on the wrapping machine of FIG. 1 and in an operational configuration of wrapping a film around a load.

With reference to FIGS. 1 and 2, there is illustrated, by way of non-limiting example, a wrapping machine 100 provided with a horizontal rotating ring 101 (i.e. rotating around a vertical axis) and arranged for wrapping a load 60 with a film 50 of cold-stretchable plastics material. The rotating ring 101 is rotatably supported by a frame 102 that is movable linearly along a vertical movement direction T that is substantially parallel to a wrapping axis W around which the ring 101 rotates. The frame 102 is slidably supported by, for example, a pair of uprights or columns 103. The wrapping machine 100 comprises an unwinding apparatus 10 of the film 50 fixed to the rotating ring 101. The unwinding apparatus 10 includes a support 2 arranged for rotatably supporting a reel 3 of film 50, a first prestretching roller 4 and a second prestretching roller 5 that cooperate to unwind and prestretch the film 50, a first motor 6 and a second motor 7 coupled with and separately rotating around respective longitudinal axes the first prestretching roller 4 and the second prestretching roller 5, respectively. The second prestretching roller 5, the so-called fast roller, which is located downstream of the first prestretching roller 4, the so-called slow roller, with respect to the movement of the film 50, rotates faster than the first prestretching roller 4 to enable the film 50 to be prestretched by a defined quantity or percentage. The first prestretching roller 4 is rotated by the first motor 6, for example by a first belt 31 that engages a first pulley 32, connected to a respective supporting shaft of the first prestretching roller 4, and a second pulley 33 connected to the first motor 6. Similarly, the second prestretching roller 5 is rotated by the second motor 7, for example by a second belt 34, which engages a third pulley 35, connected to a respective supporting shaft of the second prestretching roller 5, and a fourth pulley 36 driven by the second motor 7.

Alternatively, the prestretching rollers 4, 5 can be driven by the respective motors 6, 7 by chains, gear units and equivalent motion transmission systems.

Still alternatively, the two motors 6, 7 can be fixed to the movable frame 102 so as to drive the respective prestretching rollers 4, 5 by known motion transmission means, including, for example, flexible elements such as belts or chains.

In a further alternative, the unwinding apparatus 10 can comprise a single motor driving one of the two prestretching rollers, which in turn drives, by a transmission/reduction unit, the other prestretching roller.

The wrapping method of the invention unwinds a defined length or quantity of film for each revolution of the unwinding apparatus 10 around the load 60, suitably driving the prestretching rollers 4, 5.

The method also enables the quantity of film to be unwound or dispensed by revolution to be calculated not only on the basis of the dimensions and shape of load 60 to be wrapped but also as a function of dynamic operating parameters of the machine, in particular as a function of the rotation and translation speed of the unwinding apparatus 10 and a wrapping pitch of the film 50 on the load 60.

During operation, in particular during the wrapping step or process, the rotating ring 101 is rotated around the load 60 around the wrapping axis W at a defined rotation speed or angular speed ω (rad/s) and is moved linearly (as it is supported by the movable frame 102) parallel to the aforesaid wrapping axis W at a defined movement or translation speed $V_t$. The unwinding apparatus 10 is thus movable along a cylindrical helical trajectory. Similarly, the film 50 unwound from the reel 3 is wrapped around the load 60 with a helical movement, i.e. in such a manner as to form coils or bands with a helical or helix pattern.

In order to stabilize the load 60 and consolidate wrapping, in an initial and in a final wrapping step the film 50 is wrapped for a plurality of revolutions respectively around a lower end (base) and an upper end portion (top) of the load (or vice versa), maintaining the ring 101 fixed linearly, the trajectory of the film 50 wrapped around the load 60 in the final wrapping step being circular.

Figure 3:
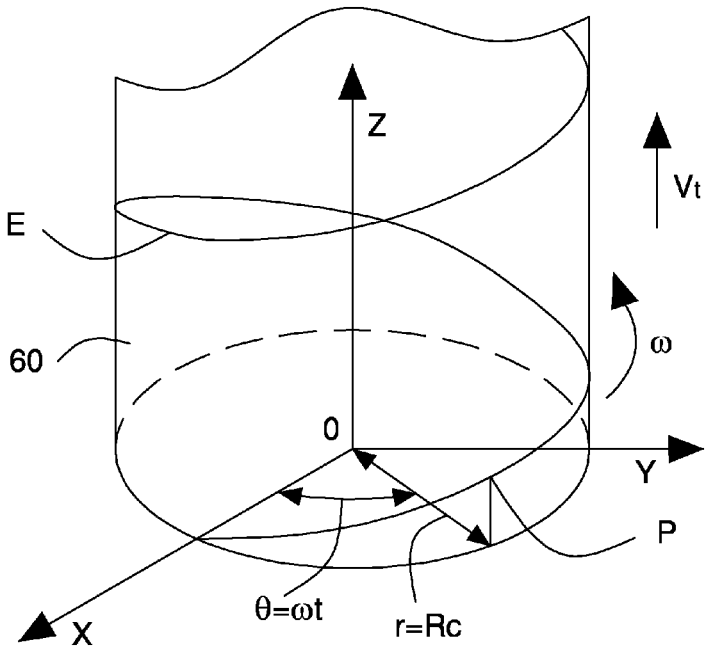
FIG. 3 is a schematic view that illustrates a helical motion with which the unwinding apparatus is moved during the process of wrapping the film around the load.

FIG. 3 illustrates schematically the helical wrapping movement of the film 50 around the load 60 with reference to a triad of orthogonal axes X, Y, Z, the third vertical axis Z coinciding with the wrapping axis W of the machine 100. For simplicity and convenience of representation and description the load has been assumed to have a straight cylindrical shape with a radius $R_c$.

In FIG. 3, for simplicity P indicates a point of the film 50 that is progressively wrapped around the load 60 along a helical wrapping trajectory or circular wrapping helix E, the aforesaid point P being movable along the helix E during the process of wrapping at the angular speed ω (rad/s) and the translation speed $V_t$ (m/s) of the unwinding apparatus 10. The ratio between the aforesaid angular speed ω and translation speed $V_t$ defines the wrapping pitch, i. e. the pitch $P_e$ of the circular helix E.

In particular, as the circular helix E of film 50 is wrapped around the load 60, the radius r of the circular helix E substantially coincides with the radius $R_c$ of the load ($R=R_c$).

The parametric equations of the circular helix E i. e. the coordinates that define in a general instant of time t (s) the position of the point P are:

$$\begin{cases} x = r\cos\omega t \\ y = r\sin\omega t \\ z = V_t \cdot t \end{cases} \quad \text{(eq. 1)}$$

If θ=ωt indicates the angle travelled over time t by P in relation to a (horizontal) plane parallel to the plane X-Y and the pitch of the helix $P_e$ is introduced the equations (eq. 1) can be rewritten as follows:

$$\begin{cases} x = r\cos\theta \\ y = r\sin\theta \\ z = \frac{P_e\theta}{2\pi} = b\theta \end{cases} \quad \text{(eq. 2)}$$

With $b=P_e/2\pi$

By deriving the parametric equations (eq. 2) of the helix with respect to time it is possible to calculate the module of the speed ν of the point P, defined by the ratio of the movement s with respect to time t:

$$v = \frac{ds}{dt} = \sqrt{\left(\frac{dx}{dt}\right)^2 + \left(\frac{dy}{dt}\right)^2 + \left(\frac{dz}{dt}\right)^2} = \sqrt{(-r\sin\theta)^2 + (r\cos\theta)^2 + b^2\frac{d\theta}{dt}} \quad \text{(eq. 3)}$$

and thus obtain $$ds=\sqrt{r^2+b^2}d\theta \quad (4)$$

It is thus possible to calculate the length Lf of the arc of the cylindrical helix E travelled in one revolution:

$$L_f = \int_0^{2\pi} \sqrt{r^2 + b^2}\, d\theta = 2\pi\sqrt{r^2 + b^2} \quad \text{(eq. 5)}$$

The length Lf of the helix arc E coincides with the length or quantity of film to be unwound for each revolution of the unwinding apparatus 10 around the load 60 when the unwinding apparatus 10 rotates at angular speed ω and moves linearly at translation speed $V_t$.

If the unwinding apparatus 10 is not movable linearly ($V_t$=0 and b=0), for example to bind the base or the top of the load 60, the quantity $L_f$ of film to be dispensed will be the same as the circumference of the load 60:

$$L_f = \int_0^{2\pi} \sqrt{r^2}\, d\theta = 2\pi r \quad \text{(eq. 6)}$$

The equation (eq. 5) shows how this length of film $L_f$ is a function of both the radius r of the load 60 and of the pitch of the helix $P_e$ (as $b=P_e/2\pi$).

If the load 60 does not have a cylindrical shape, the radius r of the film wrapping helix E is calculated on the basis of a quantity of film $S_f$ required for wrapping the load 60 by assuming the ring 101 to be stationary at a height, i.e. to have a translation speed $V_t$=0. This quantity of film $S_f$ is substantially determined as a function of the dimensions and shape of the load 60 and almost coincides with the perimeter thereof.

The (theoretical) helix radius r can be calculated as follows:

$$r = \frac{S_f}{2\pi} \quad \text{(eq. 7)}$$

It should be mentioned that although the pitch of the helix $P_e$ is a set parameter it does not have a constant value during operation of the wrapping machine 100. In the vertical movements parallel to the wrapping axis W the rotating ring 101 does not move in fact at a constant speed. Each completed movement of the ring 101 is in fact matched by an acceleration step and a deceleration step of the linear motion during which the translation speed varies. Similarly, the rotation speed of the ring 101 is not constant because of the presence of acceleration and deceleration steps of the rotation motion. Further, as the rotation axis of the ring 101 is not generally a controlled axis, rotation thereof is subject to speed variations and oscillations compared with the theoretical set speed.

The pitch of the helix $P_e$ is thus calculated by the following ratio:

$$P_e = \frac{V_t}{\omega}2\pi = \frac{V_t}{n}60 \quad \text{(eq. 8)}$$

where:

$V_t$ (m/s) is the translation speed of the ring 101;

ω (rad/s) is the rotation speed of the ring 101; and n (rpm) is the rotation speed of the ring 101 expressed in revolutions per minute.

This ratio has moreover also been already used in the system (eq. 2) that defines the parametric equations of the circular helix E.

The pitch of the helix $P_e$ is further linked to the width or height of the strip or band H of the film 50 and to a superimposed value G of the strips of film 50 around the load according to the equation:

$$P_e=H-G$$

Introducing the values of the radius r and of the helix pitch B defined respectively by the equations (eq. 7) and (eq. 8) into the equation (eq. 5) that enables the length or quantity of film to be unwound Lf for each revolution of the unwinding apparatus 10 around the load, the following equation is obtained:

$$L_f = 2\pi\sqrt{\left(\frac{S_f}{2\pi}\right)^2 + \left(\frac{V_t}{\omega}\right)^2} = 2\pi\sqrt{\left(\frac{S_f}{2\pi}\right)^2 + \left(\frac{60V_t}{2\pi n}\right)^2} \quad \text{(eq. 9)}$$

The quantity of film to be dispensed $L_f$ for each revolution is thus calculated on the basis of the quantity of film Sf (function of the dimensions and of the shape of the load 60) and on the basis of the rotation speed co and translation speed $V_t$ of the ring 101, i.e. of the unwinding apparatus 10. Experimental tests have nevertheless shown the need to introduce a correction factor to correct the value of the quantity of film to be dispensed Lf per revolution.

These tests have, in fact, shown that for high film pre-stretching values (relative to the specific film used) and/or for limited wrapping tension values, the quality of the binding is influenced more by the speeds of the unwinding apparatus, in particular by the rotation speed thereof.

With high prestretching values (250-300%) and reduced wrapping tension (40-80N) the plastics in fact tend to lose consistency and contract transversely, forming wrinkles, folds, and longitudinal curling that make the wrapping aesthetically displeasing. Further, with certain types of loads, these wrinkles and folds cause an undesired local. adhesion of the film to load portions (for example to products that make up the load). The loss of consistency and the transverse contraction of the film substantially accentuate as the rotation speed of the rotating ring diminishes.

The correction factor $\Delta_{film}$ of the quantity of film to be dispensed can be calculated by the following experimentally determined equation:

$$\Delta_{film} = \frac{L_f \times \Delta_{corr} \times \omega}{\omega_{max}} \quad \text{(eq. 10)}$$

in which:

- $\omega$(rad/s) is the rotation speed of the rotating ring during the wrapping step;
- $\omega_{max}$ (rad/s) is the maximum rotation speed of the ring; and
- $\Delta_{corr}$ (%) is a corrective parameter having a percentage value comprised between −5 and +5, in particular comprised between −3 and +3.

The value of the corrective parameter $\Delta_{corr}$ is set after a few short experimental tests and substantially considers the characteristics of the film material, the thickness of the film, the prestretching percentage to give to the film, the wrapping tension, the shape of the load, etc.

The actual quantity or length $L_{fe}$ of film 50 that the unwinding apparatus 10 has to unwind for (each) revolution around the load 60 is thus determined by the following equation:

$$L_{fe}=L_f-\Delta_{film} \quad (11)$$

As the correction factor $\Delta_{film}$ can assume both positive and negative values, a decrease or an increase of the dispensed film can be obtained respectively, i.e. the effective length $L_{fe}$ of film 50 can be less or more than the quantity of film to be unwound $L_f$.

By inserting into the equation (eq. 11) the value of $L_f$ calculated with the formula (eq. 9) and the value of the correction factor $\Delta_{film}$ defined by the formula (eq. 10) the following equation is finally obtained:

$$L_{fe} = 2\pi\sqrt{\left(\frac{S_f}{2\pi}\right)^2 + \left(\frac{V_t}{\omega}\right)^2} \times \left(1 - \frac{\Delta_{corr} \times \omega}{\omega_{max}}\right) \quad \text{(eq. 12)}$$

On the basis of the calculated value of the effective length $L_{fe}$ of film 50 it is thus possible to control the operation of the motors 6, 7 that drive the prestretching rollers 4/5 in such a manner that they rotate for each revolution of the rotating ring 101 by a set number of revolutions required to unwind the actual length of film $L_{fe}$ and if 10 requested perform the required prestretch.

The value of the effective length $L_{fe}$ of film can be calculated, and the motors 6, 7 driven accordingly, also during the wrapping process, for example when the rotating ring 101 is not linearly movable ($V_t$=0) to bind the end, base and top portions of the load.

The wrapping method of the invention thus calculates with the formulas defined and disclosed above an effective quantity or length $L_{fe}$ of film 50 to be dispensed at each revolution to wrap on the load 60, the effective length $L_{fe}$ being correlated with the rotation speed $\omega$ and with the translation speed $V_t$ of the unwinding apparatus 10.

An advantage of the wrapping method of the invention is to obtain better management of the wrapping process and better binding quality of the film on the load without the need to perform the laborious and lengthy tests required with known wrapping methods.

Another advantage is to be able to vary during the wrapping process the effective length $L_{fe}$ of film 50 to be dispensed in such a manner as to maintain the desired values of the wrapping tension of the bands or strips of film 50 wrapped with a helical motion in the central portion of the load and of those wrapped with a circular motion in the end portions of the load.

Using the wrapping method of the invention leads to appreciable improvements in the binding quality compared with known methods, especially when the work conditions of the wrapping machine are "extreme", i.e. with high prestretch percentage values, very low wrapping tension or "pull" values, great differences in the rotation speed of the ring, reels with a wide strip, low thicknesses of the film of plastics, etc. Also under these work conditions, using the method of the invention, it is possible to wrap the load with a correctly distributed and stretched film, without wrinkles or folds being formed and with limited and established transverse contraction.

The wrapping method of the invention disclosed above can also be used on a wrapping machine with a vertical ring, with a horizontal rotation axis, or on a rotating arm machine or on a machine with a rotatable platform and a vertical column.

In the case of a wrapping machine with a vertical rotating ring the rotation speed is the speed of the unwinding apparatus fixed to the vertical rotating ring rotating around a horizontal wrapping axis, whereas the translation speed is the linear speed at which the load is moved horizontally through the vertical rotating ring.

In the case of a wrapping machine with a rotating arm the rotation speed is the speed at which the arm that supports the unwinding apparatus rotates around the wrapping axis, whereas the translation speed is the linear speed at which the unwinding apparatus is moved vertically along the arm, In one wrapping machine with a rotatable platform the rotation speed is the speed at which the load rotates on the platform around the vertical wrapping axis, whereas the translation speed is the linear speed at which the unwinding apparatus is moved vertically along the fixed support column of the machine.

The invention claimed is:

1. A method for wrapping a load with a film using a wrapping machine including an unwinding apparatus provided with a reel of film, comprising the steps of (a) moving said unwinding apparatus and said load in relation to one another;

(b) unwinding from said reel an established length of film per revolution of said unwinding apparatus or of said load, said established length of film being calculated with the formula:

$$L_{fe} = 2\pi\sqrt{\left(\frac{S_f}{2\pi}\right)^2 + \left(\frac{V_t}{\omega}\right)^2} \times \left(1 - \frac{\Delta_{corr} \times \omega}{\omega_{max}}\right)$$

where $S_f$ is an initial length of film determined on the basis of one of dimensions and shape of said load;

$\omega$ is a rotation speed of said unwinding apparatus or of said load around a wrapping axis;

$V_t$ is a movement speed of said unwinding apparatus or of said load parallel to said rotation axis;

$\omega_{max}$ is a maximum rotation speed of said unwinding apparatus or of said load around said wrapping axis; and $\Delta_{corr}$ is a corrective parameter.

2. A method according to claim 1, wherein said moving step comprises (a) rotating said wrapping apparatus and said load in relation to one another around said rotation axis at said rotation speed; and (b) moving said unwinding apparatus or said load parallel to said rotation axis at said movement speed in order to wrap said load in a series of strips or bands of film having a helical path.

3. A method according to claim 2, wherein said series of bands with a helical path has a helix pitch $P_e$ defined by the equation:

$$P_e = \frac{V_t}{\omega} 2\pi = \frac{V_t}{n} 60$$

where n is said rotation speed expressed in revolutions per minute.

4. A method according to claim 1, wherein said moving step comprises rotating said wrapping apparatus and said load in relation to one another around said rotation axis at said rotation speed in order to wrap said load in a series of strips or bands of film having a circular path.

5. A method according to claim 1, wherein said corrective parameter has a percentage value between −3 and +3.

6. A method according to claim 1, wherein said initial length of film is calculated as one of a perimeter of said product and a prestretching percentage applied to said film before wrapping the load.

7. A method according to claim 1, wherein said unwinding step comprises rotating at least a first roll of said unwinding apparatus by an established number of revolutions of said wrapping apparatus or of said load to enable said established length of film to be unwound.

8. A method according to claim 1, wherein said rotation speed and said movement speed are substantially constant average speeds.

* * * * *